United States Patent [19]

Baxter et al.

[11] 4,052,565

[45] Oct. 4, 1977

[54] WALSH FUNCTION SIGNAL SCRAMBLER

[75] Inventors: Denmer Dix Baxter, Orlando, Fla.; Charles Michael Reeves, Dalton, Mass.

[73] Assignee: Martin Marietta Corporation, Orlando, Fla.

[21] Appl. No.: 581,695

[22] Filed: May 28, 1975

[51] Int. Cl.[2] ..... H04K 1/00

[52] U.S. Cl. ..... 179/1.5 S; 179/1.5 R; 325/32; 179/15 BC; 178/22

[58] Field of Search ..... 178/22; 179/1.5 R, 15 BC; 235/152, 156

[56] References Cited

U.S. PATENT DOCUMENTS

| | | | |
|---|---|---|---|
| 3,204,035 | 8/1965 | Ballard et al. | 179/15 BC |
| 3,678,204 | 7/1972 | Harmuth | 179/15 BC |
| 3,742,201 | 6/1973 | Groginsky | 235/156 |
| 3,859,515 | 1/1975 | Radcliffe, Jr. | 235/164 |

*Primary Examiner*—Howard A. Birmiel

*Attorney, Agent, or Firm*—Julian C. Renfro; Gay Chin; Howard L. Bernstein

[57] ABSTRACT

A digital speech scrambler system allowing for the transmission of scrambled speech over a narrow bandwidth by sequency limiting the analog speech in a low-pass sequency filter and thereafter multiplying the sequency limited speech with periodically cycling sets of Walsh functions at the transmitter. At the receiver, the Walsh scrambled speech is unscrambled by multiplying it with the same Walsh functions previously used to scramble the speech. The unscrambling Walsh functions are synchronized to the received scrambled signal so that, at the receiver multiplier, the unscrambling Walsh signal is the same as and in phase with the Walsh function which multiplied the speech signal at the transmitter multiplier. Synchronization may be accomplished by time division multiplexing sync signals with the Walsh scrambled speech. The addition of the sync signals in this manner further masks the transmitted speech and thus helps to prevent unauthorized deciphering of the transmitted speech.

19 Claims, 10 Drawing Figures

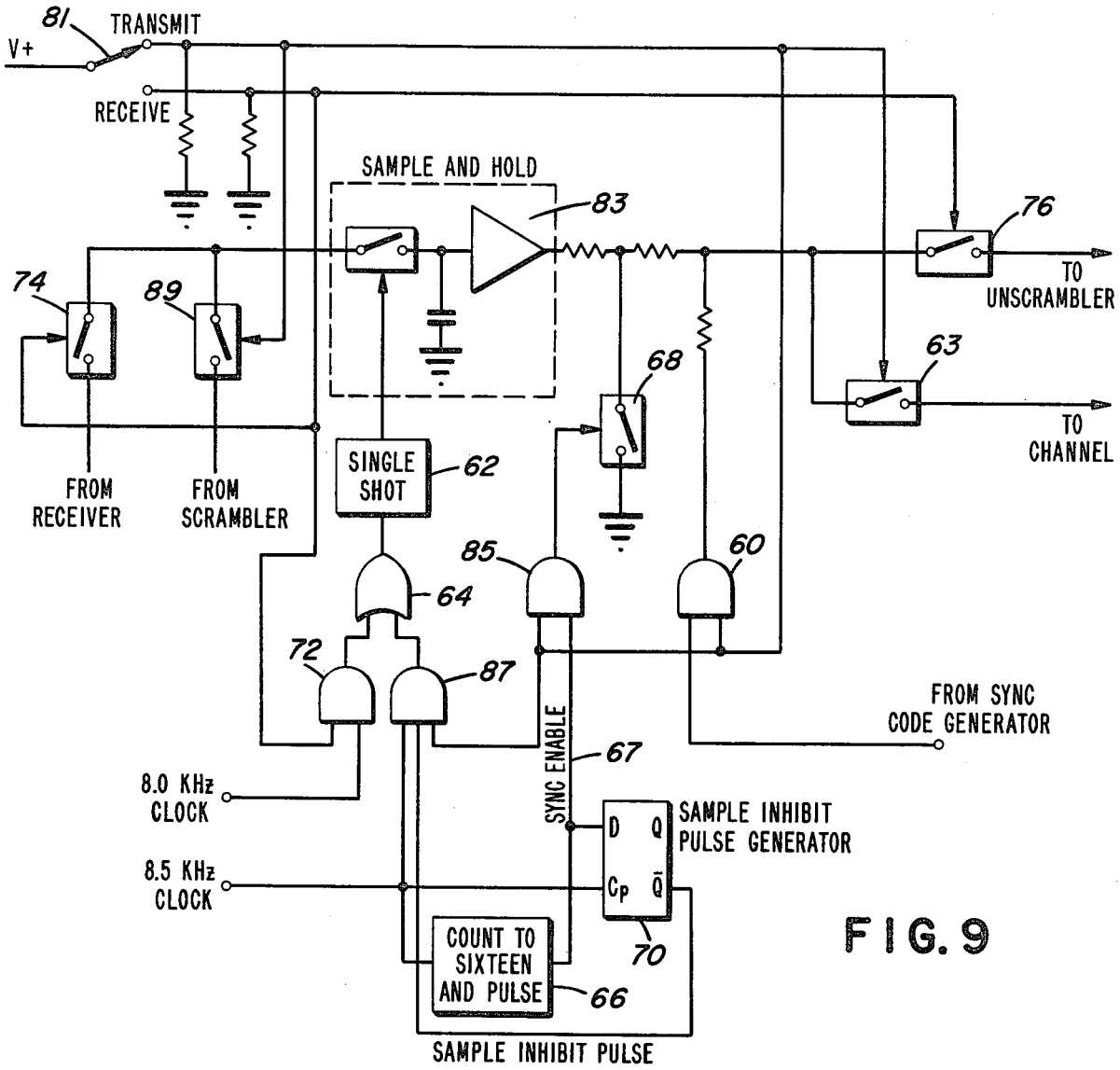
FIG. 9
FIG. 10
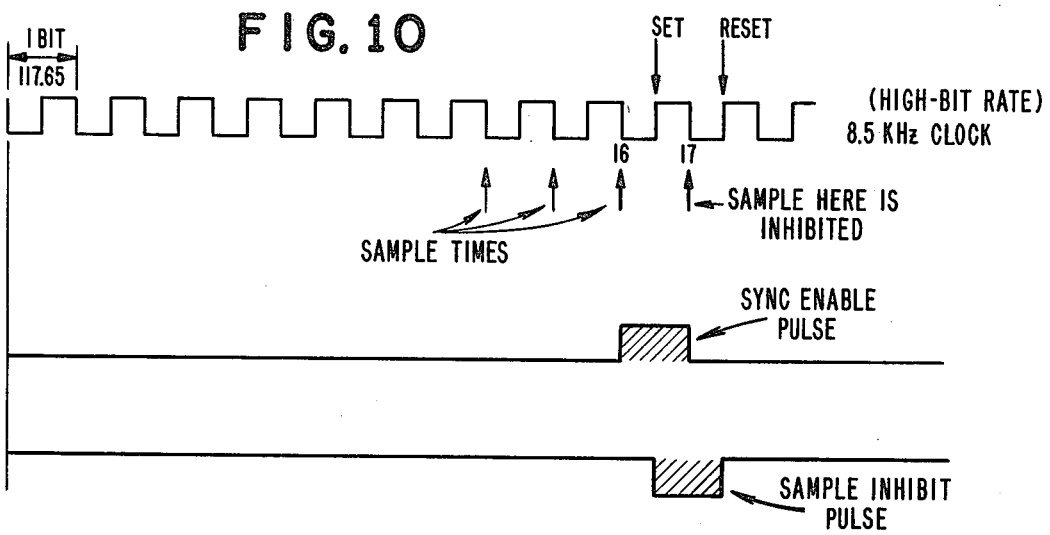

WALSH FUNCTION SIGNAL SCRAMBLER

BACKGROUND OF THE INVENTION

1. Field of the Invention

The invention is in the field of information signal privacy systems and particularly signal coders and decoders which scramble and descramble, respectively, the information signal.

2. Description of the Prior Art

An information signal scrambler system operates to convert the analog information, which may be speech and for ease in explanation will hereinafter be referred to as speech, into a non-intelligent garble prior to transmission, thereby preventing unauthorized deciphering of the speech communication over an exposed transmission link. At the receiver, the speech is unscrambled to recover the information content. Such systems are particularly applicable to military and civil law enforcement communication channels where channel security is a major concern. For example, in battlefront conditions, orders from the command station to front line troops must be kept secret since the enemy normally attempts to eavesdrop on these communications.

Various speech scrambler systems are currently available to offer communication privacy. Some of these use spectrum folding, others use inversion techniques, while still others use combinations of these techniques. The spectrum manipulation usually employs single-sideband techniques with the inherent requirement for at least two narrowband, single-sideband filters—often mechanical. The scramblers are, therefore, costly and not amenable to micro-miniaturization by using LSI technology. More specifically, certain of the presently available scrambler systems utilize a technique which provides for the frequency and/or phase shifting of portions of the analog speech signal. At the receiver, the scrambled signal is unscrambled by shifting its frequency and/or phase back to its original position. However, due to the inherent limitations of such systems with respect to the total number of frequencies and phase shifts available, these systems are relatively unsecure. That is, it is relatively easy for an unauthorized listener to unscramble the transmission.

In attempts to improve upon scrambler systems, attempts have been made to digitize the speech and modulate it with a digitized pseudorandom code. However, such systems have been found to be complicated and expensive and further require a bandwidth much greater than is normally available for either radio or telephone transmission of the unscrambled speech.

SUMMARY OF THE INVENTION

It is an object of this invention to provide an improved information scrambling-unscrambling system which is particularly effective for narrowband transmission of good quality, highly private speech.

It is a further object to provide such a system which can operate in a bandwidth not much greater than that available for standard radio and telephone transmission of analog speech.

A further object is to provide a digital scrambler system that can operate over a relatively narrow bandwidth, and is also amenable to micro-miniaturization using LSI technology.

A still further object is to provide a narrowband, digital information signal scrambler system which has a very large number of scrambling sequences, conceivably several billion.

A yet further object is to provide additional masking of the scrambled information signal by time division multiplexing synchronizing signals with the scrambled signal; said synchronizing signals also serving to synchronize the receiver generated unscrambling sequence to the received scrambled information.

It is another object to provide such a scrambler system which is compatible with and which can be easily incorporated into existing military and civil law enforcement radio systems.

The above objects are accomplished according to the present invention by a method and implementing apparatus which scrambles information signals and particularly speech signals with digitally generated sets of binary valued Walsh functions. The method involves low-pass sequency filtering of the analog speech signal to derive a sampled representation of the speech and more particularly a pulse amplitude modulation of the analog waveform, thus sequency limiting the speech signal. The sequency limited signal is multiplied by periodically varying sets of Walsh functions to develop an in-band scrambled speech signal. The feature of in-band scrambling results from a unique property of Walso function multiplication, namely that the product of two Walsh functions belonging to a set of limited sequency results in a different function of the same set. The scrambling Walsh functions are generated by a Walsh function generator which is controlled by a scrambling code sequencer dictating the sequence of scrambling Walsh functions.

A Walsh function generator at the receiver generates the same Walsh functions in the same sequence as the transmitter Walsh function generator. Sequencing of the receiver Walsh function generator is controlled by an unscrambling code sequencer. Unscrambling is accomplished by multiplying the Walsh function scrambled speech with a Walsh function identical to and in phase with the Walsh function which was multiplied with the low pass sequency filtered speech.

To synchronize the receiver generated Walsh functions to the received scrambled speech, sync signals may be time division multiplexed with the scrambled speech. The effect of this is not only to send synchronizing information with the transmitted signal but also to further mask the signal against unauthorized detection.

The result of Walsh function scrambling is to allow transmission of scrambled signals of a narrowband (0 to 4 kHz or less) using primarily digital equipment, a vast improvement over prior art scrambler systems.

BRIEF DESCRIPTION OF THE DRAWINGS

The foregoing and other objects of this invention will be more fully understood by reference to the following detailed description of the preferred embodiments taken in conjunction with the accompanying drawings in which:

FIG. 9 is a schematic diagram of circuitry which may be used to multiplex and demultiplex the sync signals with the scrambled speech, and FIG. 10 is a timing diagram for the circuitry of FIG. 9.

DETAILED DESCRIPTION OF THE PREFERRED EMBODIMENT

Figure 1:
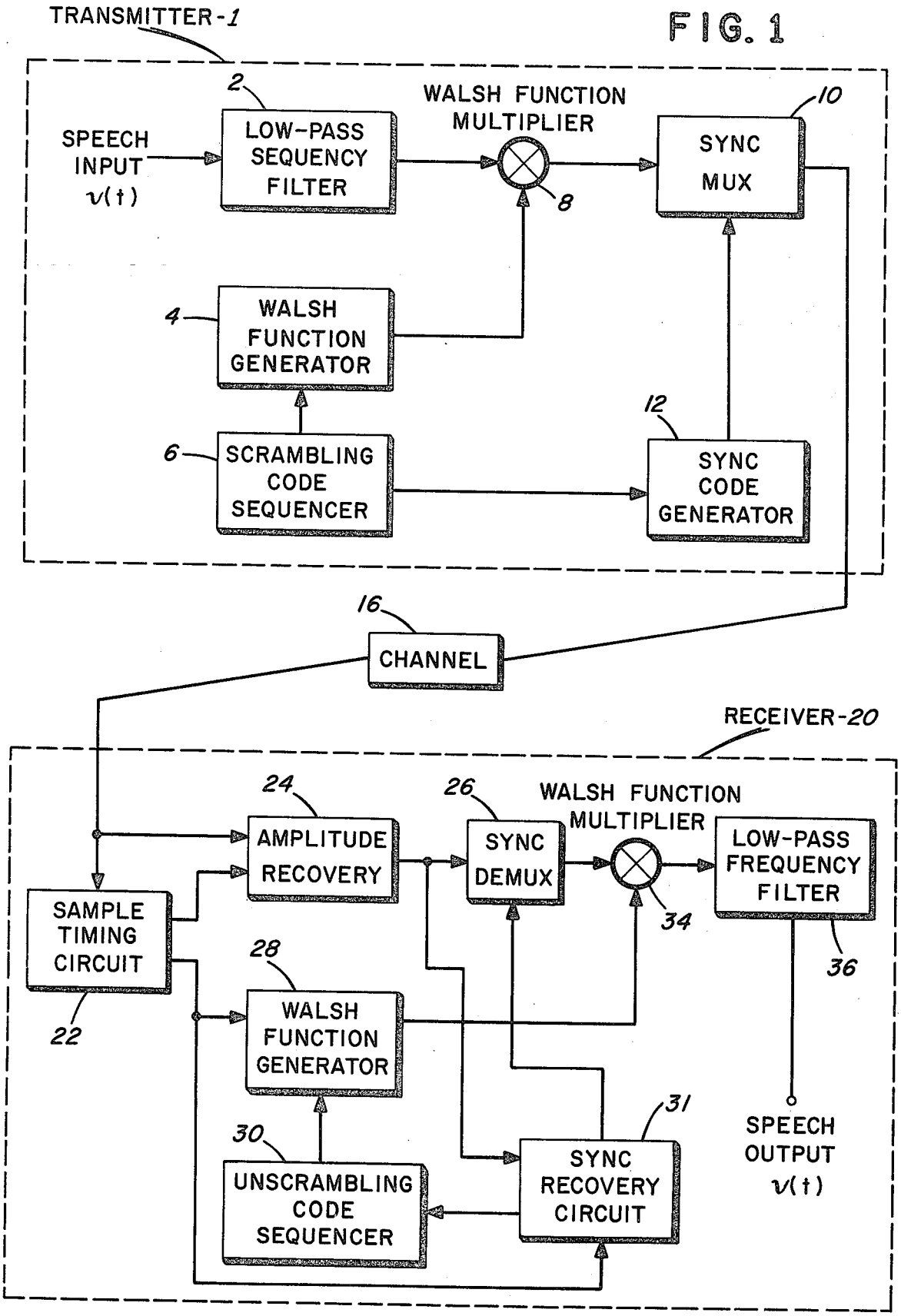
FIG. 1 is a functional block diagram of the coder and decoder of the present invention.

Walsh functions, named after J. L. Walsh, are a set of complete, normalized orthogonal functions defined over an interval T and in this interval, take on the value $\pm 1$. They are orthogonal and normalized in that the average value of the product of two Walsh functions over the interval T is zero except when the two functions are the same, in which case the average value of their product over the interval is unity. Mathematically, the orthogonal, normalized properties may be represented as:

$$\frac{1}{T}\int_O^T W_n(t)W_m(t)dt = 0, \quad n \neq m$$

$$\frac{1}{T}\int_O^T W_n(t)W_m(t)dt = 1, \quad n = m$$

Where:

$W_n(t)$ and $W_m(t)$ are, respectively, the $n$-th and $m$-th indexed Walsh functions defined on a timebase duration, T.

A Walsh function, wal$(j,\theta)$, is characterized by two parameters, $j$ and $\theta$, where $j$ is defined as the Walsh index and $\theta$ the independent variable. In a time variable system $\theta = t/T$, where $T$ is a finite interval of time duration and is the basic period of the Walsh functions.

A set of Walsh functions can be divided into two classes of odd and even functions which are designated sal$(i,\theta)$ and cal$(i,\theta)$ to indicate respectively that they are somewhat analogous to sine-cosine functions, another set of orthogonal, normalized functions. Indeed, Walsh function waveforms look somewhat like clipped sinusoidal functions. The $s$ in the term sal makes reference to the analogy between sal functions and sine functions while the $c$ in cal makes reference to the analogy between cal functions and cosine functions. For each Walsh function, wal$(j,\theta)$, except for $j=0$, there is a corresponding sal$(i,\theta)$ and cal$(i,\theta)$ where: $j=2i-1$ for the odd class of functions, sal$(i,\theta)$, and $j=2i$ for the even class of functions cal$(i,\theta)$. In Walsh function terminology the term $i$ is called the normalized sequency analogous to the frequency harmonic in the sinusoidal domain. The sequency concept is derived from an interesting property of Walsh functions. Each time one of the functions changes from $+1$ to $-1$ or vice versa, it is an occurrence termed a zero-crossing. Sequency is defined as one-half the average number of zero crossings per second. Where the Walsh function is defined over the normalized time interval $\theta$, the sequency is defined as one-half the average number of zero crossings on the interval 0 to $T$, analogous to the definition of sine and cosine functions over the interval 0 to $2\pi$. However, in contrast to sine-cosine functions the zero-crossings are not necessarily equidistant.

To aid the reader in understanding Walsh functions, the first sixteen of them are shown below with the symbol "+" representing the value $+1$ and the symbol "−" the value $-1$.

| | | |
|---|---|---|
| wal(0,Θ) | ++++++++++++++++ | wal(0,Θ) |
| wal(1,Θ) | ++++++++−−−−−−−− | sal(1,Θ) |
| wal(2,Θ) | +++++−−−−−−−−++++ | cal(1,Θ) |
| wal(3,Θ) | +++++−−−−++++−−−− | sal(2,Θ) |
| wal(4,Θ) | ++−−−−++++−−−−++ | cal(2,Θ) |
| wal(5,Θ) | ++−−−−++−−++++−− | sal(3,Θ) |
| wal(6,Θ) | ++−−++−−−−++−−++ | cal(3,Θ) |
| wal(7,Θ) | ++−−++−−++−−++−− | sal(4,Θ) |
| wal(8,Θ) | +−−++−−++−−++−−+ | cal(4,Θ) |
| wal(9,Θ) | +−−++−−+−++−−++− | sal(5,Θ) |
| wal(10,Θ) | +−−+−++−−++−+−−+ | sal(5,Θ) |
| wal(11,Θ) | +−−+−++−+−−+−++− | sal(6,Θ) |
| wal(12,Θ) | +−+−−+−++−+−−+−+ | cal(6,Θ) |
| wal(13,Θ) | +−+−−+−+−+−++−+− | sal(7,Θ) |
| wal(14,Θ) | +−+−+−+−−+−+−+−+ | cal(7,Θ). |
| wal(15,Θ) | +−+−+−+−+−+−+−+− | sal(8,Θ) |
| | 0 ——— 1 | Θ axis |

It should be noted that there exists a sal and cal function for each Walsh index, except $j=0$. Wal$(0,\theta)$ assumes a constant value over the interval and is analogous to d.c.

Just as any deterministic signal can be expressed in a Fourier series or transform involving weighted sums of sines and cosines of harmonics of a basic frequency, so can a signal be expressed in weighted sums of sal and cal functions of a basic sequency. Thus, as sine-cosine functions can be used to represent signals, so can Walsh functions.

An interesting phenomenon of Walsh functions is seen in the multiplication process. As is well known, the product of two sine waves of different frequencies is the sum of two sine waves, one at the frequency sum and the other at the frequency difference. However, the product of two Walsh functions of different indices is a single Walsh function having an index equal to the modulo 2 sum of the original indices. If the two indices of the two Walsh functions to be multiplied are written as binary numbers, then the binary number of the index of the resulting product is formed by taking the modulo 2 sum of the binary numbers. Therefore, the product of a signal having a sequency spectrum with a sequency carrier results in the spectrum being shifted by the carrier sequency – a single sideband process. If the carrier sequency is inside the sequency spectrum, the sequency spectrum of the product is scrambled all about. As an example, take an information signal $v(t)$ represented by a finite sum of Walsh functions; whereby:

$$v(t) = \sum_{j=0}^{j=7} C_j \,\mathrm{wal}(j,\Theta)$$

If $v(t)$ is multiplied by a Walsh function carrier, wal$(3,\theta)$, the result is:

$$v(t)\,\mathrm{wal}(3,\Theta) = \sum_{j=0}^{j=7} C_1 \mathrm{wal}(j\oplus 3,\Theta) = C_0\,\mathrm{wal}(3,\Theta)$$

$$+C_1\,\mathrm{wal}(2,\theta) + C_2\,\mathrm{wal}(1,\theta) + C_3\,\mathrm{wal}(0,\theta)$$
$$+C_4\,\mathrm{wal}(7,\theta) + C_5\,\mathrm{wal}(6,\theta) + C_6\,\mathrm{wal}(5,\theta)$$
$$+C_7\,\mathrm{wal}(4,\theta)$$

From this can be seen that the multiplication resulted in the coefficients retaining their initial values but they now weight different Walsh functions. Thus, the multiplication does not produce additional terms but only scrambles the sequencies with the given coefficients. Another interesting feature of Walsh function multiplication is that multiplying the product with the Walsh function carrier, wal(3,$\theta$), restores the original signal elements.

From this property of Walsh functions we developed a novel information signal scrambling apparatus. The information signal may be speech, music, video, or any other type of information bearing signal which will be assumed as speech since it is with respect to speech signals that it is contemplated the invention will be most useful. Incoming speech signals are processed by a Walsh function speech scrambler of the invention and then applied to a conventional transmission medium such as telephone wires, microwave transmission systems, or any other wired or wireless conventional channel. The specific transmission channel between transmitters and receivers used to carry the Walsh scrambled speech is conventional and does not, of itself, form a portion of the invention being described herein.

In the ensuing discussion the Walsh function speech scrambler will be described with respect to a communications system using separate transmitters and receivers at each station. However, the circuitry described may be adapted to transceiver equipment.

FIG. 1 is a block diagram of the Walsh function speech scrambler and descrambler of the present invention. Speech scrambling is accomplished at the transmitter in the following manner. Time variable, analog speech signals are applied to a low-pass sequency filter 2 wherein the analog speech signal is converted into a sequency limited pulse amplitude modulated (PAM) signal. As will be described in greater detail, the low-pass sequency filter is necessarily constructed as an integrate-and-dump circuit in which the integrator, continuously receiving the incoming speech signal v($t$), is sampled just prior to the dump operation. The sample is then stored in a suitable memory, such as a capacitor, for a time interval T', where T' is the shortest time the highest selected index Walsh function retains a fixed polarity. The next sample is taken at time T'. Thus, sequency limiting is controlled by selecting the time interval T'. For speech scrambling systems, T' may be selected as 125 microsec. Such sampling is analogous to sampling a 4kHz band limited signal at the 8 kHz Nyquist rate when operating in the frequency domain.

As the sequency filter 2 operates on the incoming speech signal, a Walsh function generator 4 synchronously generates a Walsh scrambling signal which is combined with the sequency limited PAM speech signal in Walsh multiplier 8. Since the Walsh scrambling signal is a time varying signal having a value of either $+1$ or $-1$, the multiplier 8 may take the form of a sign changer which multiplies the sequency filtered speech by $\pm 1$ as the Walsh function generator 4 dictates. The output of the multiplier 8 is Walsh scrambled speech.

In the simplest embodiment of the invention, the sequency limited PAM speech signal is multiplied by a single Walsh function which, as previously explained, has the effect of scrambling the sequencies of a Walsh series with their coefficients. Added security is obtained when the Walsh function used to scramble the PAM speech signal is varied periodically in some predetermined manner known to the descrambler apparatus at the receiver. To accomplish periodic variation of the scrambling Walsh function there is provided a scrambling code sequencer 6. Sequencer 6 operates to generate digital code words each designating a different Walsh function. When a particular Walsh function is to be generated by the function generator 4, its digital code word is produced by the sequencer 6 and applied as the input to function generator 4.

As will be described more fully, hereinbelow, descrambling is accomplished at a receiver by multiplying the received Walsh scrambled signal with the Walsh function used to form the scrambled signal. The descrambling Walsh function which is generated at the receiver must, of course, be in phase with the Walsh function modulating the sequency limited information signal. Thus, it is necessary to provide the system with a means for providing the receiver with information sufficient for it to generate the proper Walsh function in proper phase with the received scrambled signal whereby unscrambling can result.

Various synchronization techniques which may be used to transmit the phasing information to the receiver are known. For example, synchronization information may be carried on a separate channel, in which case the synchronization information may take the form of user generated codes which in this case may be an additional Walsh function. Another approach is to transmit pilot signals along with the scrambled speech. Alternatively, a sync burst can be transmitted at the beginning of the transmission to properly phase the scrambling code sequencer and Walsh function generator at the receiver, after which the receiver would free run for the duration of the transmission.

For more reliable synchronization, a sync signal can be transmitted along with the scrambled speech. It has been determined that it is particularly advantageous if the synchronization information is modulated on sync pulses interleaved in a time division manner between scrambled information samples. Thus, in a preferred embodiment of the invention sync signals are generated by a synch code generator 12 keyed to the scrambling code sequencer 6. The sync code generator is responsive to the digital code words from sequencer 6 to generate these sync signals. The sync signals are combined with the Walsh scrambled voice signal in a sync multiplexer 10. The output from the sync multiplexer 10 is applied to any conventional channel 16 to be transmitted to a receiver 20. The sync signals are recovered at the receiver and used to control an unscrambling code sequencer 30 which in turn dictates the Walsh function and its phase produced by a Walsh function generator 28.

Considering the receiver 20 illustrated in FIG. 1, the scrambled speech with its sync signals, when such signals are transmitted, is removed from the channel in a conventional manner. The scrambled signal is applied to the amplitude recovery circuit 24 where the PAM form of the signal is restored by synchronously averaging and sampling. A sample timing circuit 22, which can be a phase locked loop, generates timing pulses for sample timing which are applied to the amplitude recovery circuit 24, Walsh function generator 28, and the sync recovery circuit 31.

The output from circuit 24 is applied to the sync demultiplexer 26 which functions to remove sync signals from the scrambled speech. The recovered Walsh scrambled speech, without the sync signals, is applied to Walsh function multiplier 34. A second input to the multiplier 34 is the unscrambling Walsh function generated by the Walsh function generator 28. The Walsh function generator 28 is controlled by an unscrambling code sequencer 30 which causes generator 28 to generate the proper unscrambling Walsh function, in proper phase. The unscrambling code sequencer 30 is controlled by a sync recovery circuit 31, responsive to the sync signals carried by the received scrambled signal.

As previously indicated, sync information is preferably transmitted by modulating sync pulses, time division multiplexed between scrambled information samples. The sync pulses may be amplitude modulated to form sync code words to which the sync recovery circuit 31 is responsive. Each code word represents a different Walsh function.

Each interval of speech modulated by a particular Walsh function, termed herein a frame interval, includes a sync code word modulated on the sync pulses appearing in that interval. This code word identifies the modulating Walsh function. The sync recovery circuit 31 stores the sync code words identifying each of the possible scrambling Walsh functions and compares each of these with the incoming signals. When a match is detected, the proper unscrambling Walsh function is identified.

Figure 4:
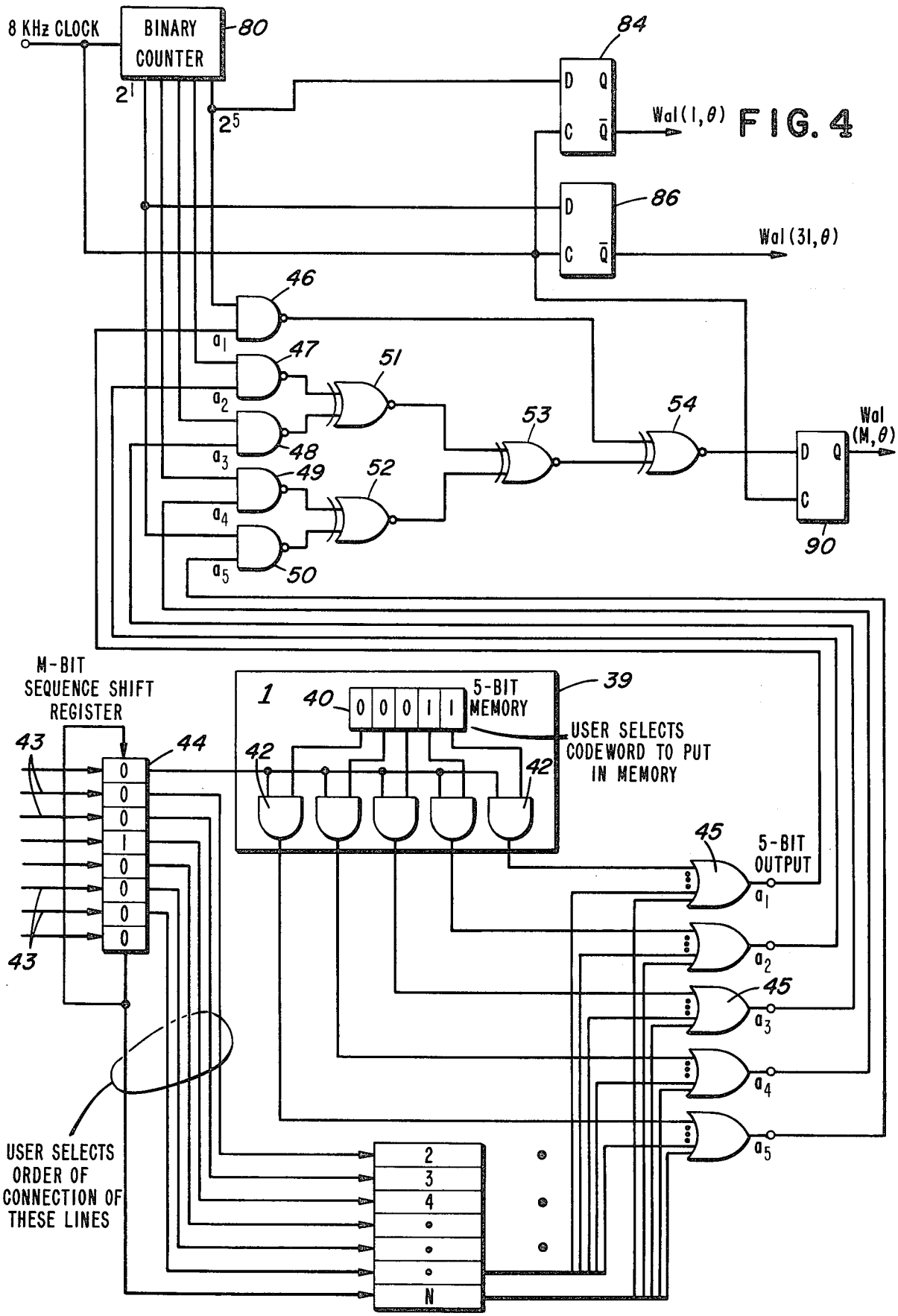
FIG. 4 is a detailed schematic diagram of the Walsh function generator and scrambling code sequencer for use in the coder and decoder of FIG. 1.

The sync recovery circuit may comprise a correlator, a sync code word memory and confidence counter. These circuits and their operation are, per se, conventional and do not of themselves form a portion of the invention. The correlator functions to compare the received sync code words with each of the receiver stored sync code words during each frame interval. When a match is detected, a code word designator identifying the proper Walsh function to be generated by Walsh function generator 28 is loaded into a sequence shift register 44 forming a part of unscrambling code sequencer 30. Register 44 is shown in FIG. 4 and described in greater detail hereinafter. The sync confidence counter determines the relative validity of incoming sync information from the correlator. It maintains a state of zero confidence until two properly spaced correlations have been made, since in a start-up situation the probability of any correlation being valid is the same as for any other one. Thus, the confidence counter jumps to a state of TWO when there is a correlation at the proper interval from one received in the start-up situation. Valid correlations from that point on increment the counter and invalid correlations (no pulse from the correlator when anticipated) decrement the counter. In the zero-confidence state every correlation is assumed correct and is loaded into the sequence shift register 44. In a higher state, the load input to the sequence shift register 44 would be inhibited.

With the proper Walsh function being generated in proper phase by the function generator 28 and applied to multiplier 34, the sequency limited speech is recovered at the output of multiplier 34. To convert the sequency limited speech back into its time varying analog form it is applied to low pass frequency filter 36.

As previously indicated, transmission privacy is increased if several scrambling Walsh functions are used. A high degree of privacy is realized with thirty-one different Walsh functions. The thirty-one different functions are the first thirty-one, that is wal(1,$\theta$) through wal(31,$\theta$). This being the case, the following implementation of the present invention is given with reference to a scrambler having a Walsh function generator capable of generating wal(1,$\theta$) through wal(31,$\theta$).

Figure 2:
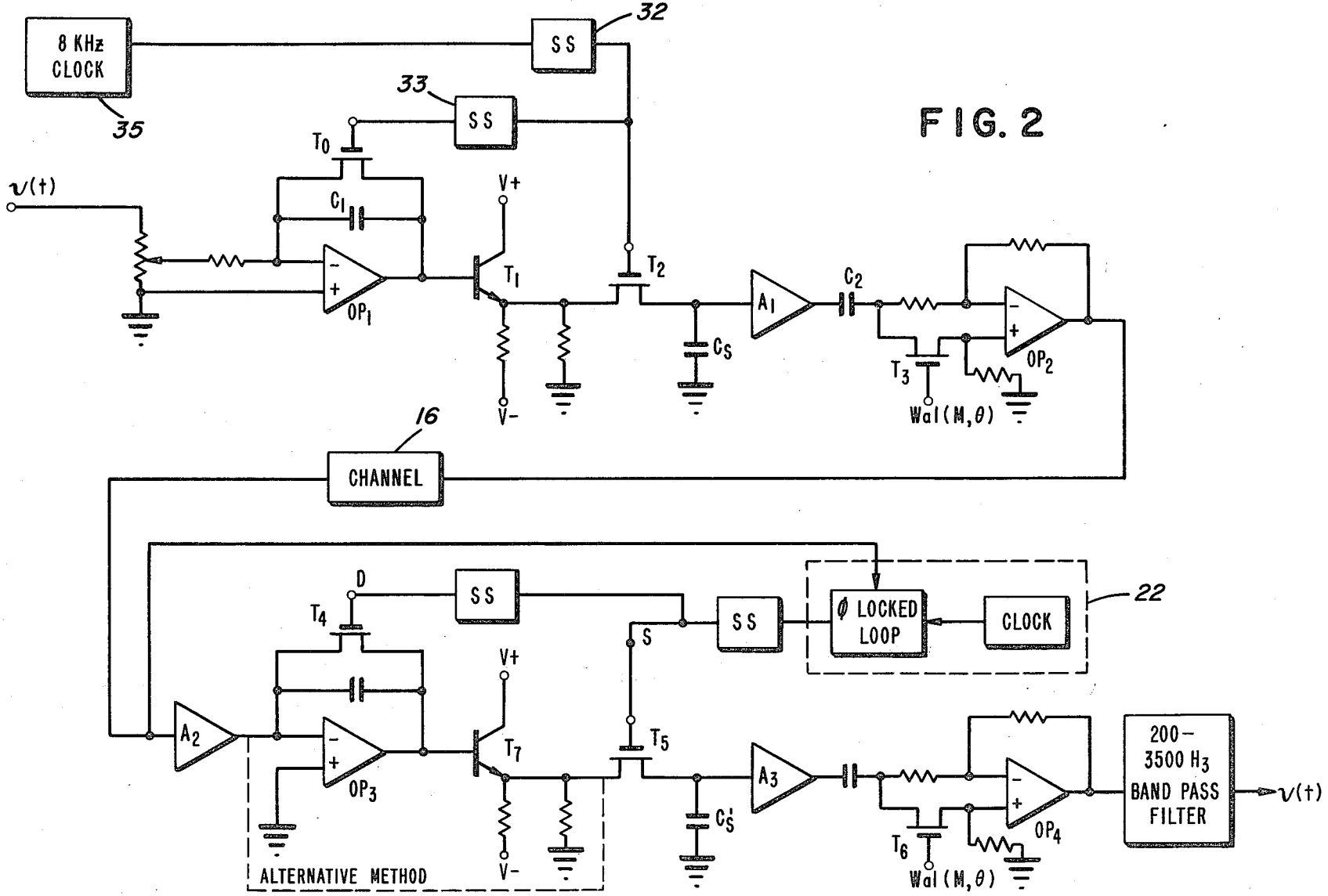
FIG. 2 is a schematic representation of a low-pass sequency filter and Walsh function multiplier for use in the coder and decoder of FIG. 1.

The details of the scrambling and descrambling circuitry, omitting sync, will now be explained with reference to FIGS. 1 and 2. Incoming voice signals are applied to the low-pass sequency filter 2 which is comprised of operational amplifier $OP_1$, functioning as an integrate and dump circuit. The integrated speech is applied through emitter-follower transistor $T_1$ to a transistor switch $T_2$ which is preferably an MOSFET switch. Sample pulses are applied to the gate of transistor $T_2$ rendering it conductive for approximately 1 microsec. to transfer the integrated speech sample stored on capacitor $C_1$ of amplifier $OP_1$ to capacitor $C_s$. Each sample pulse is followed by a dump pulse of approximately 1 microsec. duration rendering transistor $T_0$ conductive thus discharging capacitor $C_1$. Transistor $T_0$, like transistor $T_2$ and the other switching transistors to be described, is preferably an MOSFET. Timing of the sample and dump pulses to transistors $T_2$ and $T_0$ respectively is controlled by the 8kHz system clock 35, and single-shots 32 and 33. A clock pulse to the input of single-shot 32 causes a 1 microsec. pulse output rendering transistor $T_2$ conductive for substantially the length of the single-shot 32 output pulse. The trailing edge of the output from single-shot 32 triggers a single-shot 33 rendering $T_0$ conductive after transistor $T_2$ becomes non-conductive.

Thus, once every 125 microsec., the average value of the speech signal over the preceding 125 microsec. is stored on capacitor $C_s$ and dumped from integrating capacitor $C_1$. In this manner there is developed a sequency limited pulse amplitude modulated (PAM) signal representing the incoming analog speech.

Figure 3:
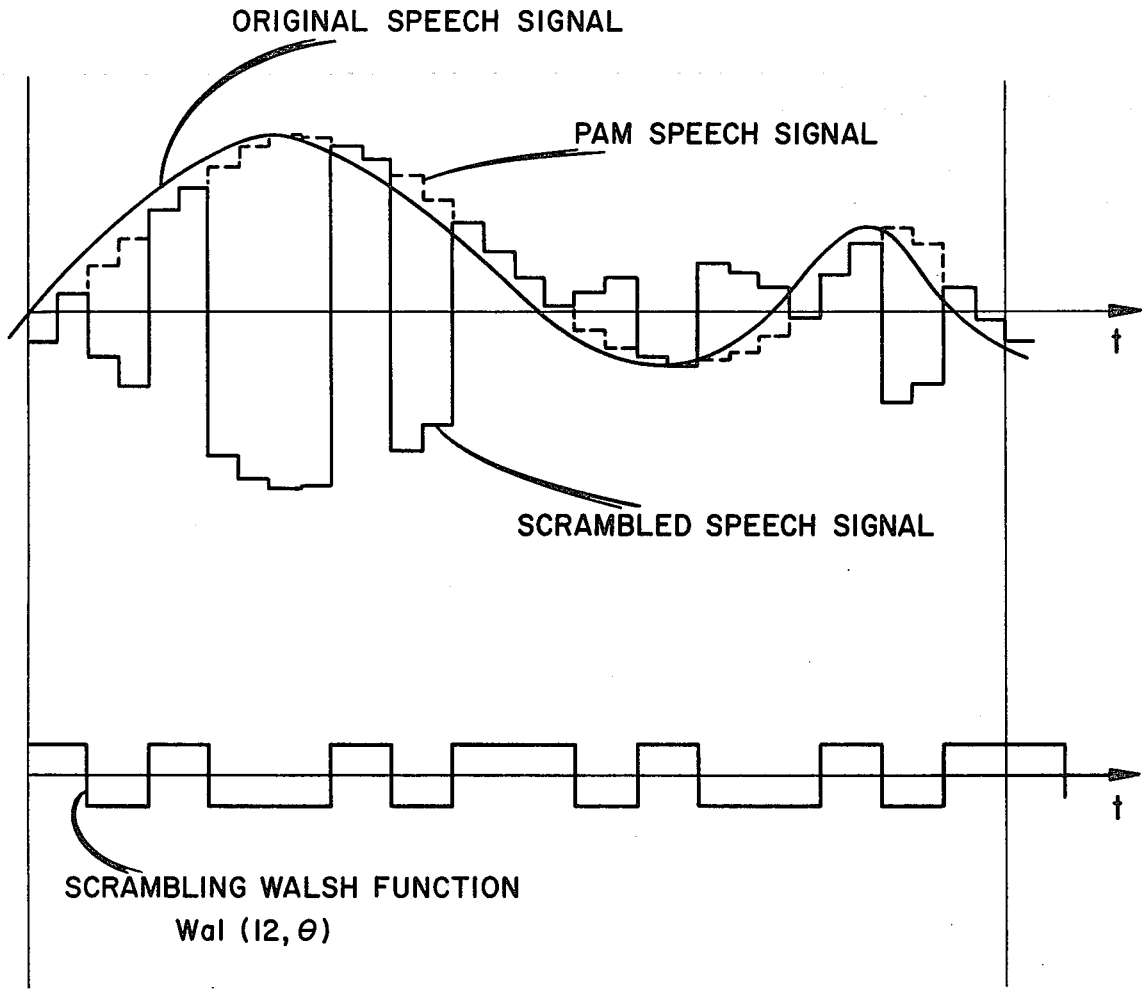
FIG. 3 is a graphical representation of Walsh function multiplication.

The PAM signal is then applied to the Walsh function multiplier 8, comprised of operational amplifier $OP_2$ and transistor $T_3$, through isolation amplifier $A_1$ and blocking capacitor $C_2$. The multiplier operates as a sign changer in the following manner. The gate of transistor $T_3$ is coupled to the output of Walsh function generator 4 to receive a Walsh function from generator 4 having a value of either $\pm 1$ at any point in time. When the Walsh function is at a $+1$ value of logic high, transistor $T_3$ is conductive and the sequency limited speech is passed through amplifier $OP_2$ with its polarity unaffected. However, when the scrambling Walsh function is at $-1$ or a logic low, transistor $T_3$ is non-conductive causing the sequency limited speech to be applied to the inverting terminal of amplifier $OP_2$. The resulting output from the amplifier $OP_2$ is a Walsh scrambled signal which is the product of wal(M,$\theta$) and the sequency limited speech. FIG. 3 is a graphical representation of the multiplier operation with wal(12,$\theta$) as the scrambling Walsh function. The Walsh scrambled speech is then applied to a conventional transmission channel for transmission to a receiver.

At the receiver, the Walsh scrambled speech is separated from the channel and applied through amplifier $A_2$ to sequency limited speech recovery circuitry in this preferred embodiment an integrating amplifier $OP_3$. Integrating amplifier $OP_3$ functions to recover the amplitude level of each received scrambled sequency limited signal sample by determining the average value during the symbol duration. The average value is sampled by transistor $T_5$ which is rendered conductive for a sampling interval once every 125 microseconds. An alternate method is to apply the output of amplifier $A_2$ directly to transistor $T_5$ and trigger transistor $T_5$ conductive near the middle of the signal interval to capture the peak value of the received signal for that interval. The sampling pulse to gate S of transistor $T_5$ and the dump pulse to the gate D of transistor $T_4$ are generated by a phase locked loop which locks the receiver clock to the received scrambled signal and which forms sample timing circuit 22. The integrating amplifier $OP_3$, transistor $T_7$, sampling transistor $T_5$ and storage capacitor $C_s'$ form the amplitude recovery circuitry 24 of FIG. 1. The recovered scrambled sequency limited signal is applied to sign changing amplifier $OP_4$ and transistor $T_6$ which together form the multiplier 34 of FIG. 1. The gate of transistor $T_6$ is connected to Walsh function generator 28 generating the unscrambling Walsh signal wal(M,$\theta$). Remembering that the scrambled sequency limited signal is the product of wal(M,$\theta$) and the sequency limited speech, and that the multiplication of that product with wal(M,$\theta$) recovers the sequency limited speech, the output of amplifier $OP_4$ is the sequency limited speech. To recover the continuous time varying analog speech v($t$) the output from amplifier $OP_4$ is passed through a 200–3500 Hz band-pass filter. In place of the band-pass filter, a low-pass filter with cut-off at 3500 Hz coulld be used.

The Walsh function generator 4 or 28 and scrambling code sequencer 6 or 30 will now be described in detail with reference to FIG. 4. The Walsh function generator and code sequencer at the transmitter and receiver are identical. The scramblng code sequencer may take the form of a pseudorandom sequence generator with five parallel outputs driving the Walsh function generator 4 or 38. The five bit code word is necessary to identify any one of the thirty-one available Walsh functions. The sequencer circuitry can take any one of several forms. The underlying principal must, however, be followed; namely, the storing of Walsh function generation codes (each representing a different Walsh function) and calling them from memory in sequence. In one embodiment, the sequencer 6 or 30 comprises N memories 39, each including a register 40 or other five bit storage means and gates 42, one gate associated with each stage of register 40. The sequencer further includes an M bit circulating ONE sequence shift register 44. The output from each stage of register 44 is connected, in a user selected manner, to one of the memories 39 and more specifically to the enabling input of each set of gates of the memory. In operation, the gates 42 of the memory 39 coupled to the stage of register 44 storing the logic high are enabled allowing the Walsh function code stored in register 40 to pass to the Walsh function generator 4 through OR gates 45. If M is selected as eight and N as five, three of the memories 39 receive two OR-ed inputs from register 44. The scrambling code generator at the transmitter and receiver are coded identically. With M eight and N five there is an eight step sequence of five Walsh functions (three are repeated). This arrangement allows for more than 130 billion different control setting permutations, permitting over nine billion different sequences.

Figure 5:
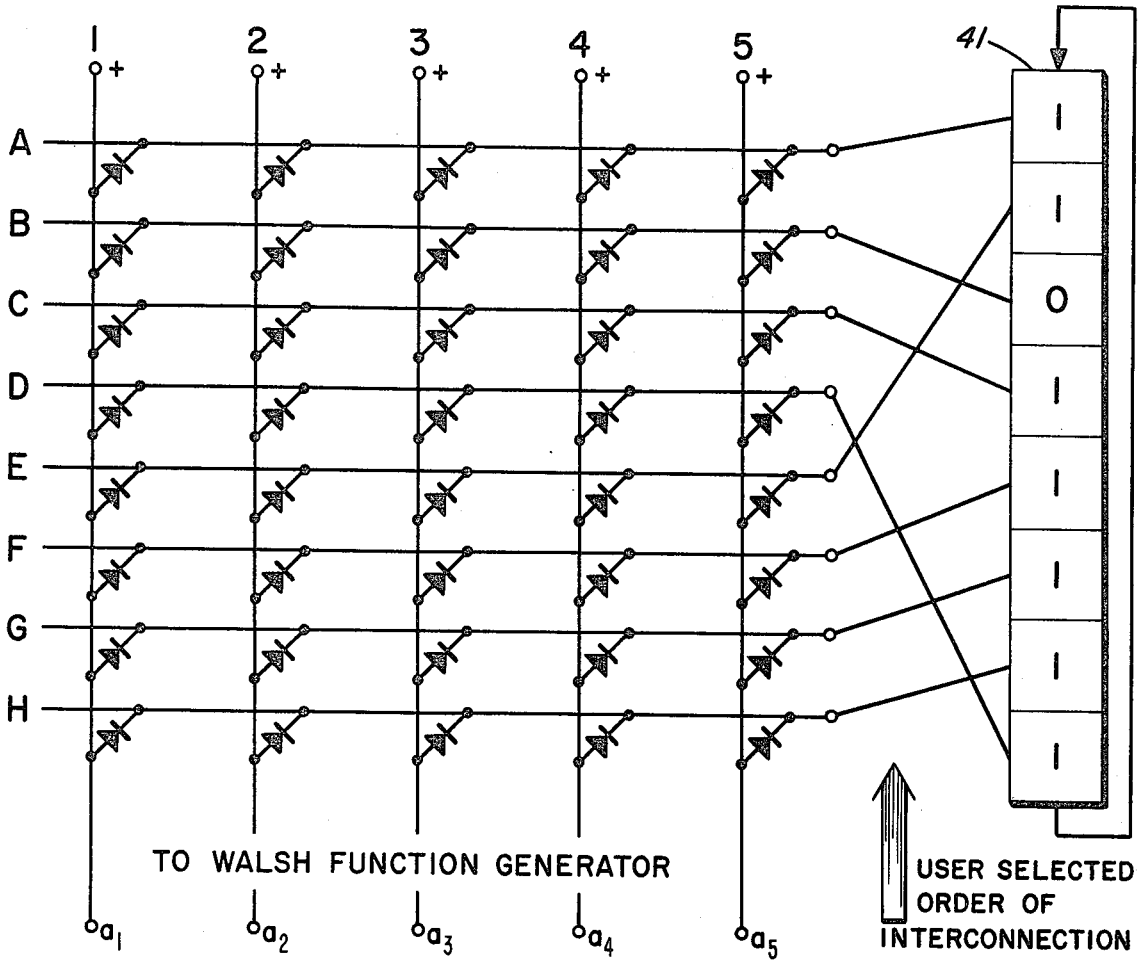
FIG. 5 is another embodiment of the scrambling code sequencer.

The scrambling code sequencer 6 may also take the form of a sequence shift register 41 in combination with a diode matrix as shown in FIG. 5. The circulating "0" in the M-bit register sequences through the N 5-bit words stored on the diodes in a user-selected order. When the "0" appears on a horizontal row (A, B, C, D, etc.), the intact diodes on that row pull down the logic connected to the outputs $a_1$ to $a_5$, which in this case is the Walsh function generator 4. This implementation is for TTL, although it is readily adaptable to other logics. Programming sequence codes into the memory is accomplished by burning out unwanted diodes. For example, to encode row A with 10010, Diodes A1 and A4 would be burned out, leaving $a_1$ and $a_4$ high when row A is strobed by the "0" in the M-bit register.

The Walsh function generator 4, 28 is shown in FIG. 4 as comprising an arrangement of NAND gates 46–50 and exclusive NOR gates 51–54. The inputs $a_1$ through $a_5$ of NAND gates 46–50 are connected, respectively, to the outputs $a_1$ –$a_5$ of the OR gates 45 in the scrambling code sequencer 6. The second input to each of the NAND gates 46–50 is connected to a counter 80 triggered by the 8 kHz system clock. Inputs $a_1$ –$a_5$ specify a particular Walsh function in the form of five bit codes stored in the registers 40. Generator 4 operates on the principle of exclusive-NOR addition of the bits of the sequence control code applied to inputs $a_1$ –$a_5$ of gates 46–50. Timing is accomplished by the use of binary counter 80 clocked by the system 8 kHz clock.

The Walsh functon generator operates in the following manner. An 8 kHz square wave clock is applied to the 5-bit binary counter 80 which has 5 output ports. The output of the first port ($2^1$) is the 8 kHz clock divided by 2 to produce the complement of the 31-st Walsh function, $\overline{\text{wal}(31,\theta)}$. The output of the second port ($2^2$) is the 8 kHz clock divided by 4 to produce the complement of the 15-th Walsh function, $\overline{\text{wal}(15,\theta)}$; etc. The counter is phased such that when the output of the fifth port ($2^5$), $\overline{\text{wal}(1,\theta)}$, goes low, all other output ports transition from high to low at the same instant. When these outputs are inverted by flip-flops 84,86, and NAND gates 46–50, the Walsh functions 1, 3, 7, 15 and 31 are produced all properly phase aligned. The flip-flops 84 and 86 provide wal(1,$\theta$) and wal(31,$\theta$) for control purposes. The Walsh function at the output of flip-flop 90, wal(M,$\theta$), is determined by the logic level inputs on $a_1$, $a_2$, $a_3$, $a_4$, and $a_5$ from the scrambling code sequencer 30 or 6.

Assume that Walsh function designator ($a_1$, $a_2$, $a_3$, $a_4$, $a_5$) is logically written (10110). This is the Gray code for the desired Walsh function written with the least significant digit first, progressing to most significant digit last. More specifically,, the code 10110 is the Gray code for the decimal number 9 which is represented by the binary equialent 01001 written in the normal notation with the more significant digits to the left. With $a_1$, $a_3$, and $a_4$ set to logic ONE, the outputs of NAND gates 46, 48, and 49 are wal(1,$\theta$) wal(7,$\theta$) and wal(15,$\theta$), respectively, while the outputs of gates 47 and 50 are at logic ONE. The exclusive-NOR gates 51–54 are equivalent to algebraic multipliers when a logic ONE is equivalent for +1 and the logic ZERO is equivalent to −1 as it is here. Therefore, the output of exclusive-NOR gate 51 is the product of wal(0,$\theta$) and wal(7,$\theta$) which is wal(7,$\theta$). Exclusive-NOR gate 52 output is the product of wal(15,$\theta$) and wal(0,$\theta$) which is wal(15,$\theta$). Exclusive-NOR 53 output is the product of wal(15,$\theta$) and wal(7,$\theta$) which is wal(8,$\theta$); that is, the bit-by-bit modulo 2 sum of the binary number notation for 7 and 15 (00111 + 01111) is 8 (01000). Exclusive-NOR gate 54 output is the product of wal(1,$\theta$) and wal(8,$\theta$) which is wal(9,$\theta$); that is, the bit-by-bit modulo 2 sum of the binary number notation for 1 and 8 (00001 + 01000) which is 9 (01001). The flip-flop 90 merely provides a retiming for the output of the exclusive-NOR 54 to remove the propagation delay ripples through the gates and to synchronously retime the output selected Walsh function.

As previously mentioned, when synchronization information is to be transmitted with the scrambled speech, it has been found advantageous to transmit such information by time division multiplexing (TDM) short duration sync pulses with the scrambled speech samples. Such sync pulses may be multiplexed with the scrambled speech between every sixteen scrambled signal samples resulting in a 6% increase in the transmission symbol rate. An important advantage is realized with the TDM method of transmitting synchronization information. The inclusion of the sync pulses in this manner has the effect of further masking the speech signal for added privacy. Time division multiplexing sync pulses provides greater masking than mere addition of these pulses to the scrambled signal in that the multiplexing process provides time distortion. Of course, both a sync pulse and a separate masking signal may be time division multiplexed with the Walsh scrambled speech. However, it is particularly convenient if the sync and masking signals are one and the same.

Figure 6:
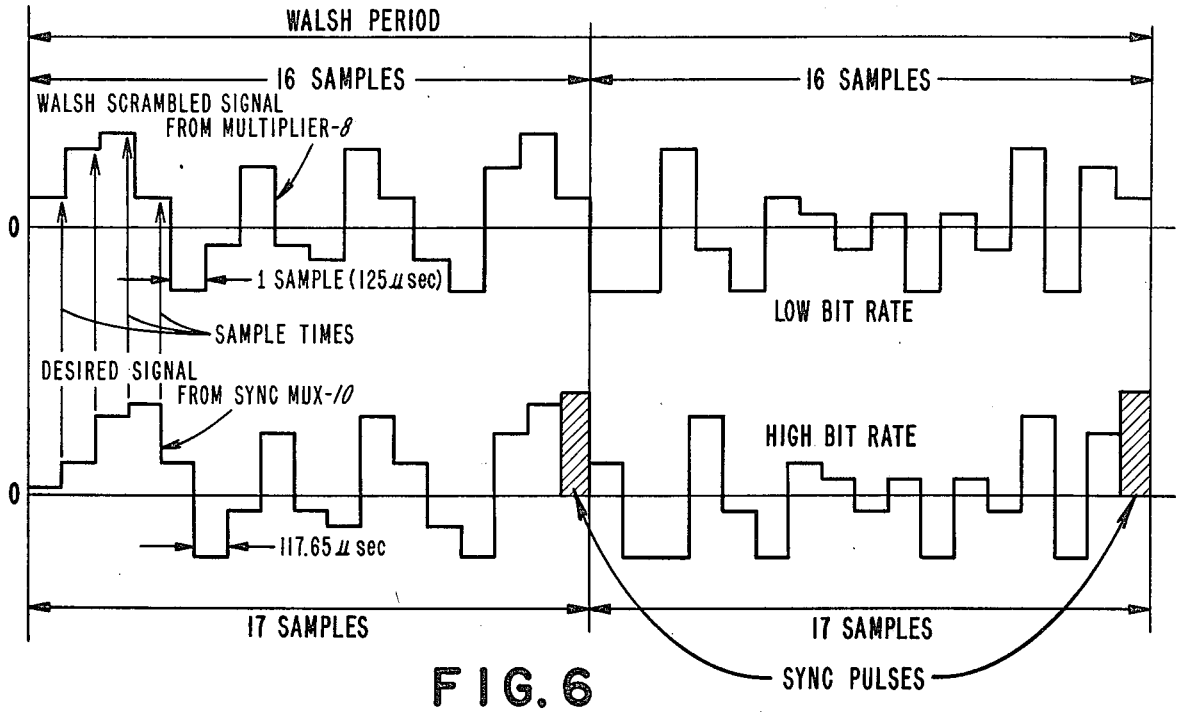
FIGS. 6 and 7 are graphical representations of the preferred technique for multiplexing and demultiplexing the sync signals with the Walsh scrambled signal.
Figure 7:
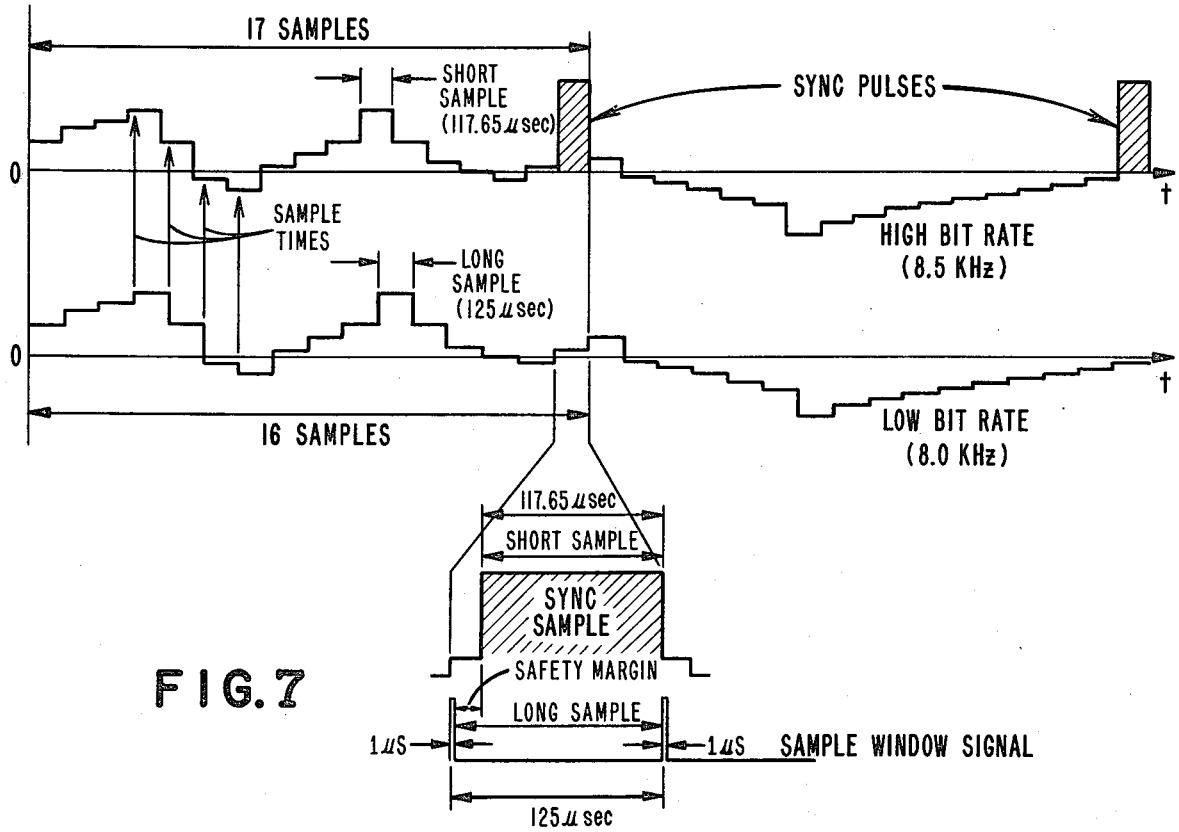

FIGS. 6 and 7 illustrate the multiplexing technique. The Walsh scrambled signal which is of PAM structure is applied to sync multiplexer 10 along with sync pulses generated by the sync code generator 12. The multiplexer 10 operates to squeeze seventeen amplitude sample pulses into the time previously occupied by sixteen pulses, with the seventeenth pulse being the sync pulse. To accomplish this, the multiplexer 10 operates to sample the incoming scrambled speech in PAM form at a rate 17/16 times as fast as the original timing rate. The multiplexer is thus clocked at the rate of 8.5 kHz.

Figure 8:
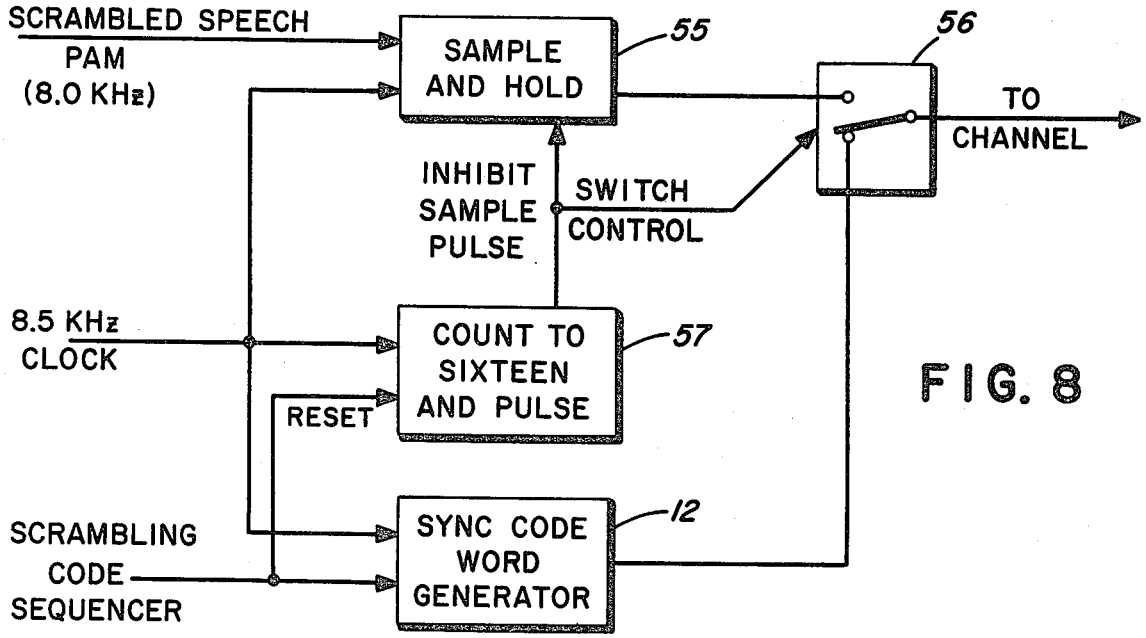
FIG. 8 is a functional block diagram of the circuitry for multiplexing the sync signals with the scrambled speech.

FIG. 8 illustrates one embodiment of the sync multiplexer 10. Each scrambling code word designator from sequencer 6 may designate a sixteen bit sync code word generated by sync code word generator 12. Counter 57 is clocked by the 8.5 kHz clock to a count of sixteen. The sixteenth cound causes the generation of an inhibit sample pulse which inhibits the scrambled speech from passing through the sample and hold circuit 55 during the seventeenth sampling interval while causing switch 56 to assume the position shown in FIG. 8 allowing one bit of the sync code word to enter the scrambled speech bit stream during the seventeenth bit interval. The amplitude of the sync pulse from generator 12 designates it as a logic 1 or logic 0. A sixteen bit sync code word would then be included among 256 data bits with 272 bits being transmitted over an interval previously containing 256 bits.

At the receiver, the modulated sync pulses are applied to the sync recovery circuit 31 and to demultiplexer 26 which may be as shown in FIG. 9 and operates to sample the received PAM structured scrambled speech 16/17 as fast as the high sampling rate of 8.5 kHz, namely 8 kHz. The 8 kHz sampling of the scrambled speech time division multiplexed with the sync pulses causes the sync pulses to fall between the sample windows and consequently be removed entirely. The demultiplexing technique is illustrated in FIG. 7.

FIG. 9 illustrates an embodiment of a sync multiplexer combined with a demultiplexer. When switch 81 is set to the transmit line, switches 89 and 63 are closed permitting the scrambled speech to enter the sample and hold circuit 83, while AND gates 87, 85 and 60 are enabled. Under these conditions, the 8.5 kHz clock triggers the single-shot 62 through OR gate 64 to produce 1 microsec. sampling windows, while counter 66 counts to sixteen. The trailing-edge of the sixteenth pulse from the 8.5 kHz clock causes counter 66 to produce a sync enable pulse on line 67 closing switch 68 to block the scrambled speech from the channel during the interval of the sync enable pulse. In addition, the sync enable pulse sets flip-flop 70, disabling AND gate 87, while a bit from the sync code generator 12 passes through AND gate 60 to the channel. As shown in the sync multiplex-demultiplex timing diagram of FIG. 10, the next leading edge of the 8.5 kHz clock resets flip-flop 70 to remove the inhibit pulse.

When operating as a demultiplexer, switch 81 is switched to the receive line to enable AND gate 72, while closing switches 74 and 76. Under these conditions, single-shot 62 is triggered at the 8.0 kHz rate through OR gate 62 thereby removing every seventeenth bit from the received signal. When the two clocks are properly synchronized, the seventeenth bit is the sync pulse.

What has been described is a unique signal scrambler which makes use of digital technology while producing a narrow-band scrambled information signal which can be transmitted over conventional radio and telephone channels. Added masking of the already scrambled information signal may be accomplished by time division multiplxing sync signals between scrambled information bits.

What is claimed is:

1. An information signal scrambler comprising:

a. means for sampling an analog information signal to develop a series of amplitude samples of the information signal, b. means for generating a plurality of Walsh function signals c. sequencer means for causing the said means for generating a plurality of Walsh function signals to periodically and cyclically change the generated Walsh function signal, and d. means for multiplying the said samples with each of the generated Walsh function signals.

2. The information scrambler of claim 1 further including, means for generating sync signals and means for time division multiplexing a sync signal between every $n$ samples of the Walsh function scrambled signal, said time division multiplexing means comprising means for sampling the Walsh function scrambled information at a rate $(n + 1)/n$ times the repetition rate of the sampled information signals, to thereby produce a blank interval in the sample stream and means for transferring the sync signal to the sample stream during the blank interval.

3. The information scrambler of claim 2 wherein:

a. said means for sampling the information signal comprises an integrating amplifier means receiving the analog information signal, first electronic switching means for periodically transferring the integrated signal from said integrating amplifier to said amplitude sample storage means, second electronic switching means for removing the integrated signal from said integrating amplifier means after the integrated signal is transferred to said amplitude sample storage means; and b. said means for multiplying the Walsh function signals with the stored samples comprises polarity inversion means including a summing amplifier and third electronic switching means responsive to the Walsh function signals for causing the samples to be applied to the inverting input of said summing amplifier whenever the Walsh function is at $-1$ value and for causing the samples to be applied to the non-inverting input of said summing amplifier whenever the Walsh function is at $+1$ value.

4. A method for providing privacy in analog electric information signal transmission systems comprising the steps of:

a. sequency limiting the information signals,
b. generating a plurality of first electrical signals having the characteristics of Walsh functions,
c. multiplying the plurality of Walsh function electrical signals with the sequency limited information signals to produce a Walsh scrambled, sequency limited information signal,
d. transmitting said Walsh scrambled, sequency limited information signal,
e. receiving the transmitted Walsh scrambled signal,
f. generating a plurality of second electrical signals having the identical Walsh function characteristics as the Walsh function electrical signals multiplying the information signal, and
g. multiplying the Walsh scrambled, sequency limited information signals with the second electrical signals to produce the sequency limited information signal.

5. The method of claim 4 further including the step of passing the sequency limited information signal through a low-passing frequency filter.

6. The method of claim 4 further including the steps of:

a. generating sync pulses,
b. modulating said sync pulses with sync code words identifying said first electrical signals having the characteristics of Walsh functions, and
c. time division multiplexing said modulated sync pulses with said Walsh scrambled, sequency limited information signal prior to transmission.

7. The method of clam 6 further including the steps of:

a. recovering the modulated sync pulses from the received Walsh scrambled information signal,
b. synchronizing the said second electrical signals to the received Walsh scrambled information signal with the use of said recovered, modulated sync pulses, and
c. demultiplexing the received, time division multiplexed, Walsh scrambled information signal with modulated sync pulses to recover the Walsh scrambled information signal.

8. An information signal scrambler comprising:

a. means for sampling an analog information signal to develop a series of amplitude samples of the information signal,
b. said means for sampling the information signal comprising an integrating amplifier means receiving the analog information signal, first electronic switching means for periodically transferring the integrated signal from said integrating amplifier to amplitude sample storage means, second electronic switching means for removing the integrated signal from said integrating amplifier means after the integrated signal is transferred to the amplitude sample storage means.
c. means for storing each amplitude sample for a time period substantially equal to the time interval between samples,
d. means for generating a plurality of Walsh function signals,
e. sequencer means for causing the said means for generating a plurality of Walsh function signals to periodically and cyclically change the generated Walsh function signals,
f. said sequencer means comprising N memory means each storing a code word representation for a particular Walsh function, each memory means including selectively enabled means for transferring its stored code word to said Walsh function signal generating means, and means for selectively enabling any one of said selectively enabled transfer means, said means for selectively enablng including means for periodically and cyclically enabling each of said selectively enabled transfer means,
g. said Walsh function signal generator means including binary counter means for generating electrical representations of inverted Walsh functions with indices $2^n-1$, logic means responsive to each of said code words stored in said N memory means for logically combining said electrical representations of said code words and electrical representations of inverted Walsh functions with indices $2^n-1$ to produce the particular Walsh function signal corresponding to the said code word applied to the logic means,
h. means for multiplying the stored samples with the Walsh function signal identified by the code word stored in the particular memory means whose transferring means has been enabled to provide Walsh scrambled signals,
i. said means for multiplying the Walsh function signals with the stored samples comprising polarity inversion means including a summing amplifier and third electronic switching means responsive to the Walsh function signal for causing the stored samples to be applied to the inverting input of said summing amplifier whenever the Walsh function signal is at $-1$ value and for causing the samples to be applied to the non-inverting input of said summing amplifier whenever the Walsh function signal is at $+1$ value.
j. means for generating sync signals and means for time division multiplexing a sync signal between every $n$ samples of the Walsh function scrambled signal, said time division multiplexing means comprising means for sampling the Walsh function scrambled signal at a rate $(n+1)/n$ times the repetition rate of the sampled signals, to thereby produce a blank interval in the sample stream and means for transferring the sync signal to the sample stream during the blank interval.

9. An information signal unscrambler for recovering information signals from Walsh function scrambled signals produced by multiplying the information signal by a plurality of different Walsh function signals, said scrambled signals being time division multiplexed with sync signals, comprising:

a. means for receiving Walsh function scrambled information signals, said means for receiving the Walsh function scrambled signals comprising integrating amplifier means and means for periodically sampling the integrated signal to thereby average the signal amplitude between sampling intervals and means for storing said averaged samples;
b. means for generating the Walsh functions used to produce the scrambled signals,
c. means for removing sync signals, time division multiplexed between $n$ samples of the Walsh scrambled information signal samples, said sync signal removal means comprising sample and hold means receiving the sync signal multiplexed scrambled signal and means for generating sample pulses at a rate $n/(n+1)$ times the rate of the received scrambled information signal samples with sync signals, d. means for multiplying the scrambled signal with the generated Walsh function signal said means for multiplying the scrambled signal with the unscrambler generated Walsh function signals comprising polarity inverter means, inverter by-pass means, and switch means responsive to the unscrambler generated Walsh function signals for causing the scrambled signal to pass through the inverter means when the value of the Walsh function signal is $-1$ and to pass through the by-pass means when the Walsh function signal value is $+1$.

10. A method for providing privacy in analog electric information signal transmission systems comprising the steps of:

a. sequency limiting the information signals, b. selectively generating any of a plurality of first electrical signals each having the characteristic of a different Walsh function, c. cyclically multiplying the sequency limited information signals with different Walsh function electrical signals to produce a sequency limited Walsh scrambled information signal, d. generating sync pulses, e. pulse amplitude modulating said sync pulses by a sync code word identifying the one of said first electrical signals multiplying said sequency limited information signal, f. time division multiplexing said modulated sync pulses with said Walsh scrambled sequency limited speech prior to transmission, g. transmitting said Walsh scrambed, sequency limited information signal, h. receiving the transmitted Walsh scrambled signal, i. recovering the modulated sync pulses from said received Walsh scrambled speech, j. selectively generating any of a plurality of second electrical signals each having the Walsh function characteristics of one of first electrical signals, k. synchronizing, in response to said recovered modulated sync pulses, the second electrical signals to the Walsh scrambled information signals so that the generated second electrical signal is the same as and in phase with the first electrical signal multiplying the sequency limited information signal, and l. multiplying the Walsh scrambled information signal with the generated second electrical signal which is the same as and in phase with the first electrical signal multiplying the sequency limited information signal forming the Walsh scrambled speech.

11. In a system for providing privacy in information signal transmission system, transmitter means comprising:

means, responsive to an analog information signal, for sampling said analog information signal to develop a series of amplitude samples of said information signal, means for generating different ones of a first plurality of Walsh function signals, sequencer means including, means for designating several of said plurality of Walsh function signals, said Walsh function signal generating means being responsive to said designator means to generate each of said designated Walsh function signals one at a time as commanded by said designator means, and means for controlling the order in which each of said several designated Walsh function signals are generated by said Walsh function signal generating means, and means for multiplying the amplitude samples of the information signals by the Walsh function signals generated by said Walsh function signal generating means whereby different portions of said information signal after being converted into a pulse amplitude modulated signal are multiplied by different ones of selected Walsh function signals out of a plurality of Walsh function signals to produce Walsh scrambled signals.

12. The privacy system of claim 11 further including, means for generating a signal representative of the state of said order controlling means and sync code generator means responsive to said signal representative of the state of the order controlling means for generating a second pulse amplitude modulated signal indicative of the state of said order controlling means.

13. The privacy system of claim 12 further including means for interleaving the individual pulses of said second pulse amplitude modulated signal with the output of said multiplier means in a time division manner.

14. The privacy system of claim 13 wherein said designator means comprises a plurality of memory means equal in number to the several of said plurality of Walsh functions, each of said memory means storing a code word representing a particular Walsh function, each memory means including selectively enabled means for transferring its stored code word to said Walsh function signal generating means, said order controlling means comprising register means coupled to said selectively enabled means for periodically and cyclically enabling each of said selectively enabled transfer means.

15. In the privacy system of claim 14 further including, means operable on said designator means to change the selected ones of said plurality of Walsh function signals which can be generated by said Walsh function signal generator means and means operable on said order controlling means to alter the order in which the selected ones of said plurality of Walsh function signals are generated.

16. The privacy system of claim 15 wherein said Walsh function signal generator means comprises binary counter means for generating electrical representations of inverted Walsh functions with indices $2^n-1$, logic means responsive to each of said code words stored in said plurality of memory means for logically combining said electrical representations of said code words and electrical representations of inverted Walsh functions with indices $2^n-1$ to produce the particular Walsh function signal corresponding to the said code word applied to the logic means.

17. The privacy system of claim 11 further comprising means for receiving said Walsh function scrambled amplitude samples, said receiver means including:

means for generating a second plurality of Walsh function signals identical to said first plurality, sequencer means comprising:

means for designating several of said second plurality of Walsh function signals, said several Walsh functions being identical to the several designated Walsh function signals designated by said transmitter designator means, said receiver Walsh function signal generating means being responsive to said receiver designator means to generate each of said designated Walsh function signals one at a time, means for controlling the order in which each of said several Walsh function signals are generated by said receiver Walsh function signal generating means, said receiver order controlling means operating to designate the several Walsh function signals at the receiver in the same order as they are designated at the transmitter, and means for multiplying the Walsh scrambled samples with the Walsh function signals being generated.

18. The privacy system of claim 17 further including means operable on said receiver designator means to alter the selected ones of said plurality of Walsh function signals and means operable on said receiver order controlling means to alter the order in which the selected ones of said plurality of Walsh function signals are generated.

19. The privacy system of claim 18 further including means for generating signals representative of the state of the transmitter order controlling means and sync code generator means responsive to said signal representative of the state of the order controlling means for providing a second pulse amplitude modulating signal indicative of the state of the said order controlling means, and means for interleaving the individual pulses of said second pulse amplitude modulated signal with the signal output from said multiplier means in a time division manner, said receiver means further including means for extracting from the received signal the pulse amplitude modulated signals indicative of the state of the transmitter order controlling means and synchronization means responsive to said recovered second pulse amplitude modulated signal for synchronizing said receiver sequencer means to cause the Walsh function signal generated at the receiver to be in proper phase with the received Walsh scrambled samples when applied to said receiver multiplying means to thereby recover the amplitude samples of the analog information signal.

* * * * *